US008485799B2

(12) United States Patent
Allen

(10) Patent No.: US 8,485,799 B2
(45) Date of Patent: Jul. 16, 2013

(54) VERTICAL FLOW CAGE AND METHOD OF USE

(75) Inventor: Curtis Allen, Artesia, NM (US)

(73) Assignee: KLM Specialties, LLC, Artesia, NM (US)

( * ) Notice: Subject to any disclaimer, the term of this patent is extended or adjusted under 35 U.S.C. 154(b) by 0 days.

(21) Appl. No.: 13/066,383

(22) Filed: Apr. 13, 2011

(65) Prior Publication Data

US 2012/0260990 A1 Oct. 18, 2012

(51) Int. Cl.
*F04B 39/10* (2006.01)
*F04B 53/00* (2006.01)

(52) U.S. Cl.
USPC ..... 417/430; 417/555.2; 166/105.5

(58) Field of Classification Search
USPC ..... 417/555.1, 430, 555.2; 92/173; 166/105.5
See application file for complete search history.

(56) References Cited

U.S. PATENT DOCUMENTS 4,768,595 A 9/1988 Smith
5,115,863 A 5/1992 Olinger
5,660,534 A * 8/1997 Snow ..... 417/554
6,155,792 A 12/2000 Hartley et al.
6,290,475 B1 * 9/2001 Snow ..... 417/430
6,886,636 B2 * 5/2005 Michael et al. ..... 166/313
7,021,387 B2 4/2006 Lee
7,428,923 B2 9/2008 Ford
2002/0031438 A1 3/2002 Skillman
2004/0055743 A1 3/2004 Vann
2006/0083646 A1 * 4/2006 Ford ..... 417/555.1
2006/0225882 A1 10/2006 Edwards
2008/0112826 A1 * 5/2008 Ford ..... 417/430
2008/0135259 A1 6/2008 Brown
2008/0217565 A1 * 9/2008 Ford ..... 251/120
2009/0084557 A1 4/2009 Obrejanu
2010/0108150 A1 * 5/2010 Ford ..... 137/14

* cited by examiner

*Primary Examiner* — Charles Freay
*Assistant Examiner* — Philip Stimpert
(74) *Attorney, Agent, or Firm* — Kevin Lynn Wildenstein

(57) ABSTRACT

The present invention is centralizing vertical flow cage attachable to a subsurface pump in a downhole recovery application, and method of use. In one embodiment, the vertical flow cage is defined as comprising a hollowed, centralizing cone portion having at least one spiral vein formed in the cone's surface. In another embodiment, the centralizing cone includes a ledge having at least one discharge hole disposed thereon, with each discharge hole being selectively located above each vein. Each discharge hole is formed through the centralizing cone so that each hole formed is in fluid communication with the hollow interior portion of the centralizing cone. In this regard, during the pump process upstroke, any fluid below and outside of the centralizing cone will be forced vertically upwards through each vein. This fluid flow will be assisted by the flow of fluid through each hole, as any fluid within the hollow portion will flow upward and through each hole, thereby providing a synergistic vertical fluid flow effect.

20 Claims, 6 Drawing Sheets

VERTICAL FLOW CAGE AND METHOD OF USE

FIELD OF INVENTION

The present invention is generally directed to an improved, centralizing vertical flow cage for use in oil and gas recovery operations, which is attachable between a rod and a downhole rod pump, and method of use.

BACKGROUND OF THE INVENTION

Depending on the project, a typical drilling project to begin fluid extraction from the Earth may go anywhere from 25 feet below the Earth's surface to well over 20,000 feet below the Earth's surface. Every drilling project is unique, and may require different parameters for use. Thus, for example, a short range depth hole may only require a small diameter hole to be dug, whereas a long range depth hole may require a much larger diameter hole to be dug. Thus, for example, a 7000 foot deep hole may typically require the creation of an approximately 18 inch diameter surface casing substantially throughout the length of the hole being dug. As the hole is being slowly dug, the drilling bit is removed from the hole, and surface casing is inserted into the diameter of the hole in order to create a reinforcement wall or barrier which also prevents any external material (such as gas or oil) from coming to the surface during the pressurized drilling process. Surface casing pipe is typically formed of a metal or metal compound and usually comes in 20 to 30 foot lengths which can be interconnectable to allow longer length casings (as may be needed for longer depth holes). The diameter of the hole being dug is generally larger than the surface casing inserted into the hole. Once the casing is installed, cement is then pumped down inside the casing and forced outside the bottom and circulated to the surface, thereby creating a permanent down hole bore. To help the cement cure, calcium chloride may be added to the cement. Calcium chloride in the cement also helps the cement to dry in adjacent water pockets underneath the Earth's surface. By cementing the casing to the Earth, a barrier is created which prevents any liquid, gas or other undesirably contaminants nearby from escaping to the Earth's surface during the drilling process.

When the drilling process is completed, and all conventional downhole stabilizing structures are in place downhole (e.g., cement casing, perforations stimulation and a tubing string), a rod pump may then be inserted into the tubing to begin the fluid (e.g., gas, oil, water, etc.) extraction from adjacent perforations P in the casing. As seen in FIG. 1, a typical downhole sucker rod pump RP (also known as a reciprocating pump) is connected to the surface pumping unit SP by a series of rods R, which are collectively commonly referred to as a "rod string". Each rod is typically formed from high strength steel or steel alloy.

A sucker rod pump RP is used primarily to draw oil from underground adjacent fluid reservoirs by providing a reciprocal (up and down) motion, but can be adapted to extract other fluids as well. In operation, the surface pump SSP pulls the sucker rod upward and then allows the rod string to be moved downwardly by gravity. During the pumping process' upstroke cycle, formation pressure allows the adjacent reservoir's fluid F to pass through a valve in the downhole sucker pump and into the barrel of the pump. The fluid F will be held in place within the barrel. On the down stroke, the travelling valve unseats and fluid inside the pump barrel will be forced into the tubing column, and while the standing valve seats, fluid is prevented from flowing out of the barrel and back into the reservoir, permitting the adjacent reservoir fluid to enter the barrel, while preventing fluid from moving back down into the hole. This process repeats cyclically, with the fluid being slowly extracted into the tubing. The fluid will continue to pass upwardly in the tubing, where it will be extracted into a storage tank or like structure.

Subsurface pumps RP are also referred to as "sucker rod pumps" in the industry. A sucker rod pump (e.g., traveling barrel pump) is a relatively simple device, and can be operated over long periods of time with relatively little cost and maintenance. Sucker rod pumps are generally attached to a lower end of a sucker rod at the ground level, and then the entire apparatus is placed into the well as a complete unit. The sucker rod pump can then be placed in a fixed location at a depth in the tubing by a seating nipple N which was pre-fitted in the tubing at the required depth. There are typically two types of downhole sucker rod pumps found in the industry, an insert (or, rod) pump, and a tubing pump. The insert pump (also known as a traveling barrel rod pump or a stationary barrel rod pump) is installed on the sucker rod string, whereas the tubing pump is attached directly to the tubing and is run into the well as a complete unit.

A typical sucker rod must extend from the surface pumping unit all the way down to the sucker rod pump, which may be several thousand feet below the surface. Currently, a modern day top discharge cage (or, discharge valve) apparatus is used to connect the rod to a downhole pump (such as a sucker rod pump). These conventional cages, however, are designed to discharge the fluid coming from within the pump horizontally (or, laterally) towards the adjacent tubing surfaces during the pumping process, thereby significantly causing erosion to the tubing surface over time due to cyclic stress, eroding the thickness of the tubing until tubing failure occurs. Tubing failure represents a significant cost to the oil recovery industry, and the industry has attempted to use stop-gap methods to try to slow the erosion process (like for example, by applying ceramic material or powder coating to the tubing), however, these methods are modestly successful. Moreover, shutting down a well in order to replace the tubing and associated structures or parts is also expensive and time consuming, resulting in loss of potential income. Further, transportation is also a high cost to consider, as parts are moved to and from the well to fix the problem. And, when worn pipe or tubing must be replaced, the long delivery time and large expense of new parts can be a significant impediment to recovery operations. When a pumping well needs service, a workover rig is usually required, which is extremely costly.

Thus, there remains a need for a centralizing vertical flow cage which substantially reduces any erosion or abrasion of the surrounding tubing surface during the pumping process. It is therefore an exemplary feature of the present invention to provide a novel method, system or apparatus for a vertical flow cage which substantially maintains longitudinal alignment in the tubing while presenting minimal resistance to the axial flow of fluids during the pumping process.

SUMMARY OF THE INVENTION

The following summary of the invention is provided to facilitate an understanding of some of the innovative features unique to the present invention, and is not intended to be a full description of variations that may be apparent to those of skill in the art. A full appreciation of the various aspects of the invention can be gained from the entire specification, claims, drawings, and abstract taken as a whole.

The present invention is centralizing vertical flow cage attached to a sucker rod pump in a downhole recovery application, and method of use. In one embodiment, the vertical flow cage is defined as comprising a hollowed, centralizing cone portion having at least one spiral vein formed in the cone's surface. In another embodiment, the centralizing cone portion may be formed with a plurality of spiral veins formed in the cone's surface, and preferably, be formed with four spiral veins. In still another embodiment, the centralizing cone includes a ledge portion having at least one discharge hole disposed thereon, with each discharge hole being selectively located above each vein. Each discharge hole formed through the centralizing cone is in fluid communication with the hollow interior portion of the centralizing cone. In this regard, during the pump process down stroke cycle, any fluid around the pump will be forced vertically upwards through each vein in a spiral or helical pattern. This fluid flow through each vein will be assisted by the flow of fluid through each hole, as any fluid from the pump travelling through the hollow portion will flow upward and through each hole, thereby providing a synergistic helically vertical fluid flow effect.

This disclosure describes numerous specific details that include specific structures and elements, their particular arrangement, and their particular functions in order to provide a thorough understanding of the present invention. One skilled in the art will appreciate that one may practice the present invention without the specific details.

The novel features of the present invention will become apparent to those of skill in the art upon examination of the following detailed description of the preferred embodiment or can be learned by practice of the present invention. It should be understood, however, that the detailed description of the preferred embodiment and the specific examples presented, while indicating certain embodiments of the present invention, are provided for illustration purposes only because various changes and modifications within the spirit and scope of the invention will become apparent to those of skill in the art from the detailed description, drawings and claims that follow.

BRIEF DESCRIPTION OF THE DRAWINGS

The accompanying figures further illustrate the present invention and, together with the detailed description of the preferred embodiment, assists to explain the general principles according to the present invention.

Additional aspects of the present invention will become evident upon reviewing the non-limiting embodiments described in the specification and the claims taken in conjunction with the accompanying figures, wherein like reference numerals denote like elements.

DETAILED DESCRIPTION OF THE PREFERRED EMBODIMENT

Figure 1:
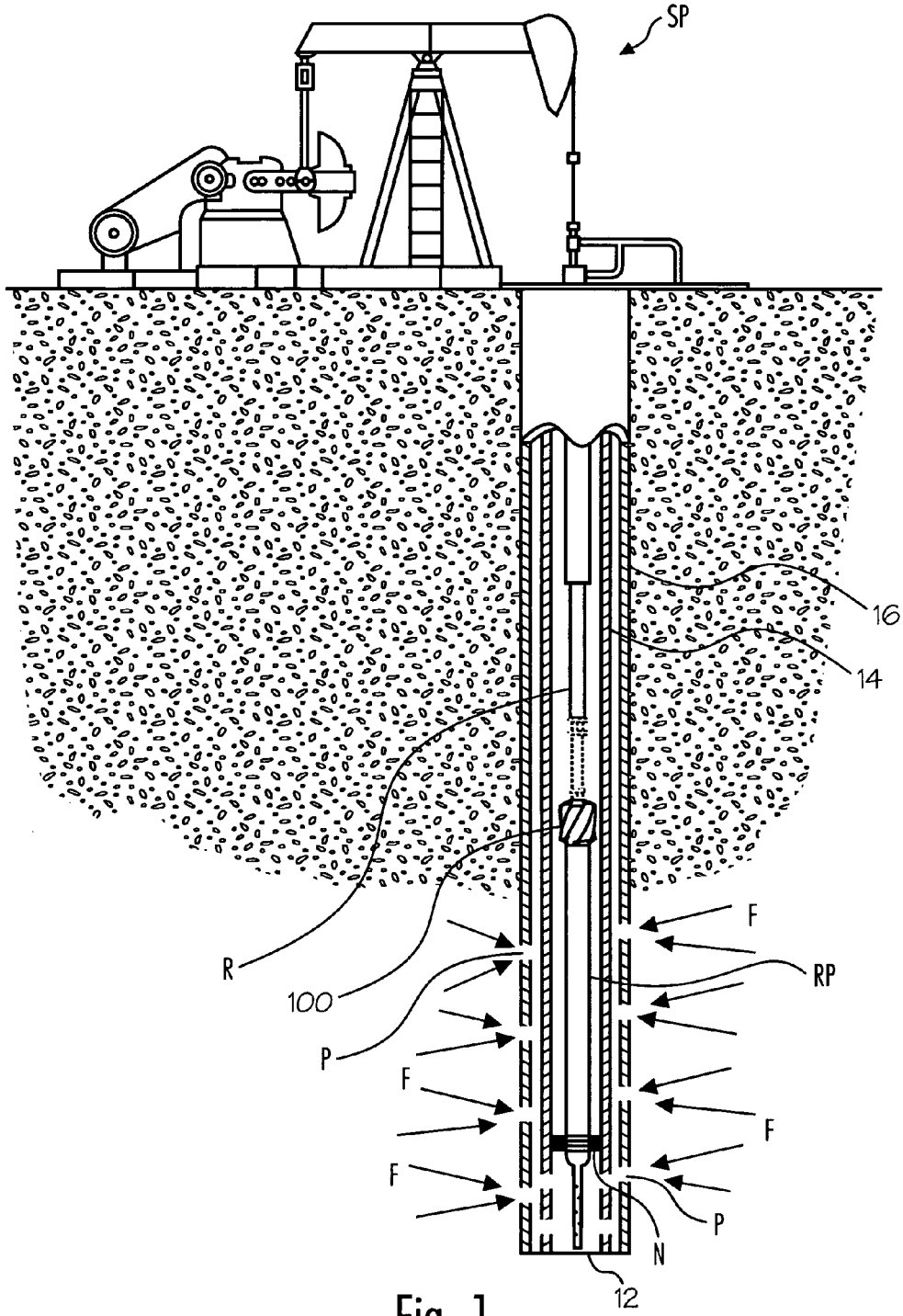
FIG. 1 illustrates an exemplary illustration of a downhole pumping process.

Returning now to FIG. 1, a surface pumping apparatus SP is depicted in use pumping fluids from a well 12 through a string of tubing 14 disposed within the well casing 16. Connected to the pumping apparatus SP is a string of sucker rods R which are connected together by typical pin and box couplings (not shown).

The present invention is a vertical flow cage 100 which is connectable between a subsurface reciprocating pump RP and a conventional rod string R, as represented in FIGS. 1-5. In one embodiment, as seen for example in FIG. 2, the vertical flow cage 100 is defined as comprising a hollow centralizing cone 101 having a top or pin end 103 and an internally threaded bottom end 105, wherein the bottom end 105 is in fluid flow communication through and with the hollow portion H. The centralizing cone 101 further includes at least one spiral or helical turbulating channel or vein $V_x$ (where x=1, 2, 3, etc.) formed in the cone's outer surface 107. Each vein $V_x$ is preferably formed on the surface 107 equidistantly around the radius of the surface 107 and preferably, is of equal width. However, those of skill in the art will realize that in some applications, each vein $V_x$ may be formed sporadically around the radius of the surface 107 with different widths and depths.

Figure 2:
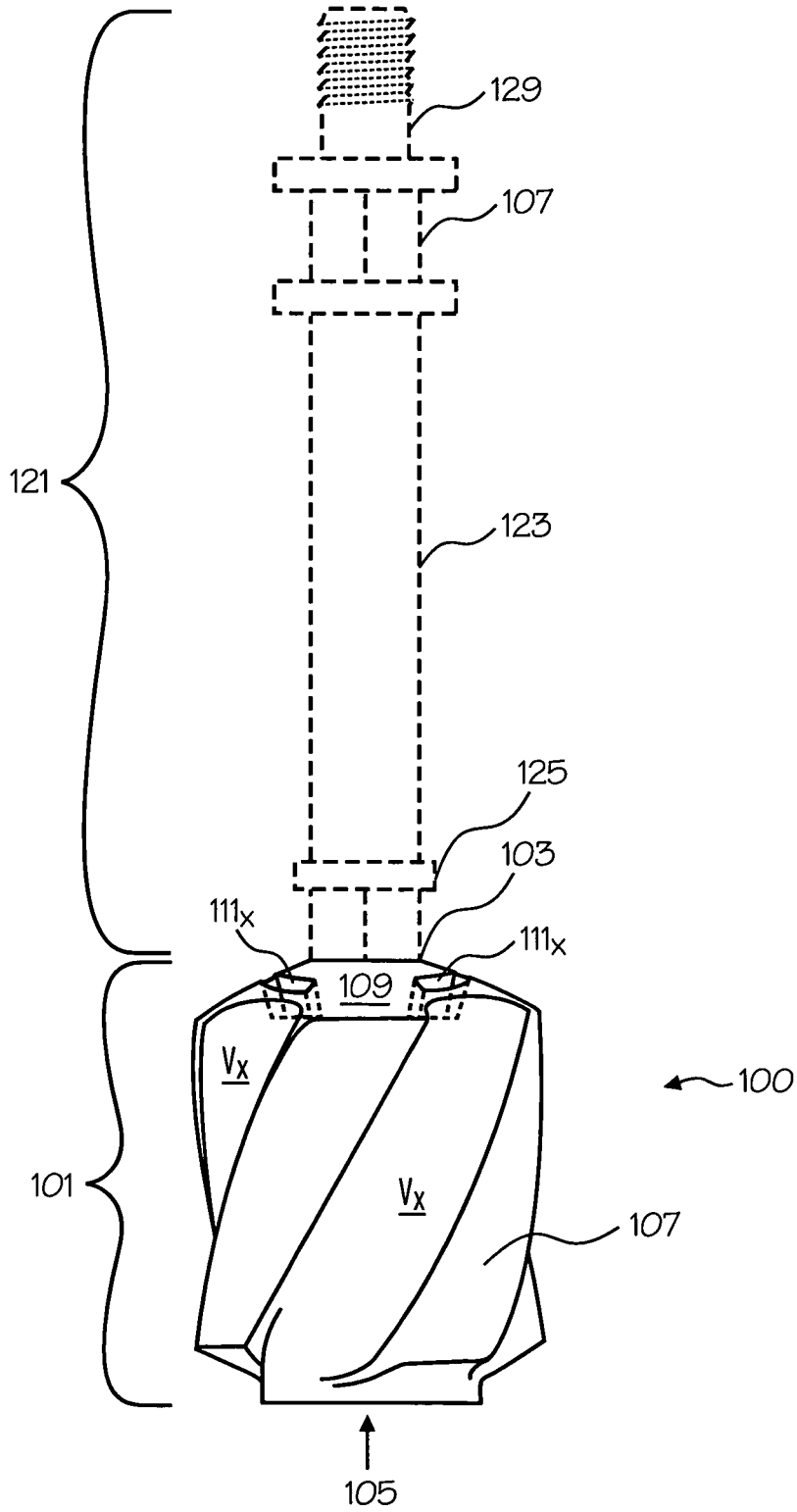
FIG. 2 illustrates an exemplary side plan view perspective of the present invention.
Figure 3:
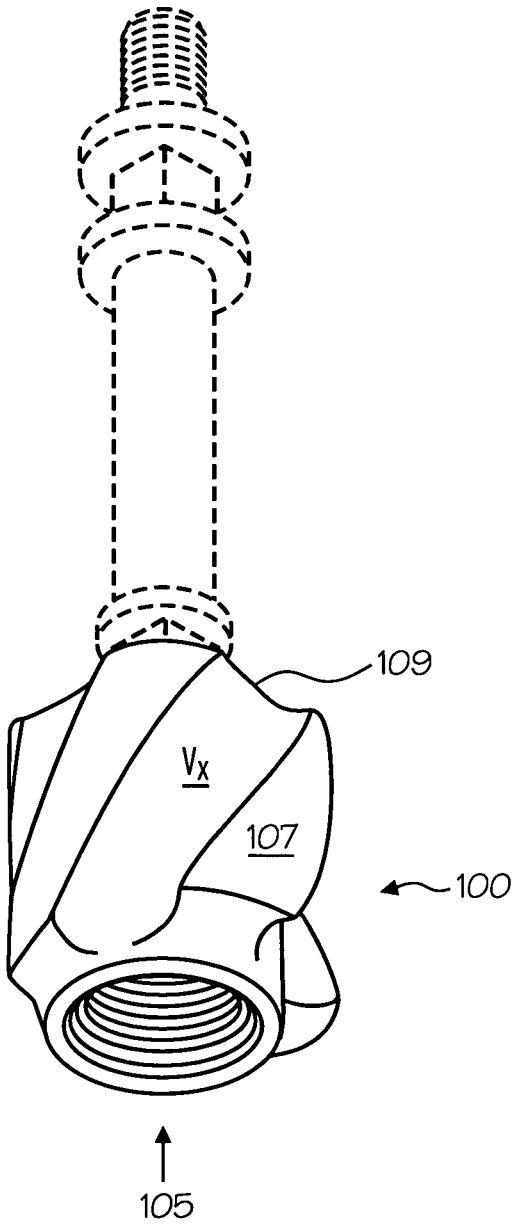
FIG. 3 illustrates an exemplary bottom side view perspective of the present invention.

As seen in FIG. 2, attached to the centralizing cone top end 103 is an optional handling means 121 adapted to couple the centralizing cone 101 to a rod string. The optional handling means, comprises in one exemplary embodiment, an elongated, T-shaped handling shaft 123 coupled to a first end by a first square 125 and coupled to a second end by a second square 127. In this embodiment, the second square 127 is coupled to a threaded portion 129 (e.g., an American Petroleum Institute approved threaded portion), adapted to be coupled to a sucker rod.

Figure 6:
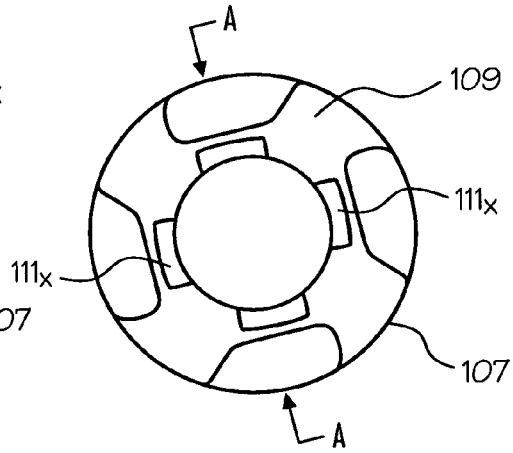
FIG. 6 illustrates an exemplary top plan view of the centralizing cone of FIG. 5.
Figure 7A:
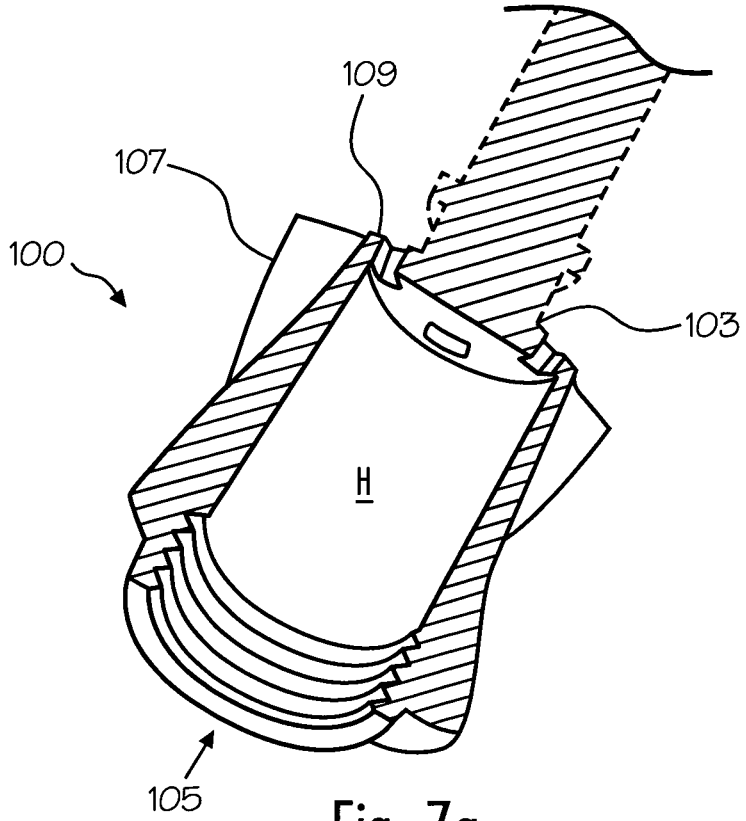
FIG. 7*a* illustrates one cutaway perspective view of an exemplary representation of the present invention along line A-A shown in FIG. 6.
Figure 7B:
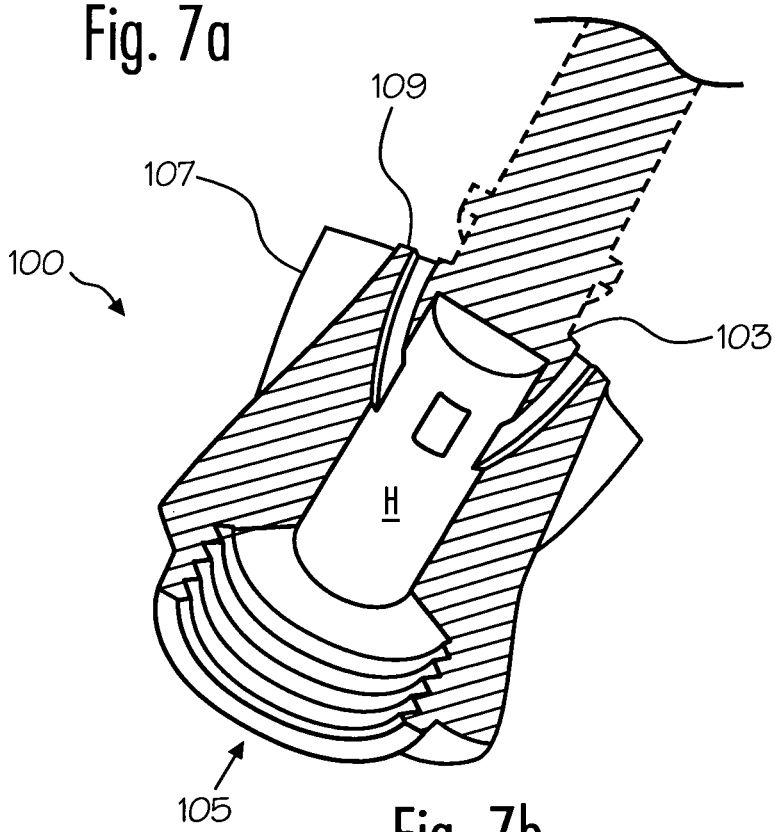
FIG. 7*b* illustrates another cutaway perspective view of an exemplary representation of the present invention along line A-A shown in FIG. 6.

Returning to the centralizing cone portion as seen in FIG. 6, for example, the centralizing cone also includes a ledge 109 having at least one top discharge port or hole $\mathbf{111}_x$ (where x=1, 2, 3, etc.) disposed thereon, with each discharge hole $\mathbf{111}_x$ being located above (or otherwise being in substantial registration with) each vein $V_x$. In a preferred embodiment, each longitudinal vein $V_x$ extends almost substantially the length of the height of the centralizing cone 101, but not extending past the ledge 109. In another preferred embodiment, there is a one-to-one correspondence between each discharge hole $\mathbf{111}_x$ and each vein $V_x$, with each hole 111*x* being located on the ledge 109 above each corresponding vein $V_x$. However, in some applications, a discharge hole $\mathbf{111}_x$ may not be necessarily formed above any particular vein, and rather, may be selectively located on the ledge 109. Each discharge hole $\mathbf{111}_x$ is formed through the centralizing cone 101 so that each hole $\mathbf{111}_x$ formed is in fluid communication with the hollow interior portion of the centralizing cone 101 as seen in, for example, FIGS. 2, 4, 7*a* and 7*b* (where the dashed lines represent the discharge hole in fluid communication with the cone's hollow portion H). Further, the exact tunnel formed by each discharge hole $\mathbf{111}_x$ in the cone 101 may be varied as seen in FIGS. 7*a* and 7*b* (where FIG. 7*a* shows each hole forming a tunnel to a ceiling of hollow portion H, and where FIG. 7*b* shows each hole forming a tunnel to a side wall of hollow portion H). Moreover, the combination of the surface areas created by the holes $\mathbf{111}_x$ on ledge 109 should preferably be at least one and a half times greater than the diameter of a hole within the traveling valve seat in order to achieve optimal flow efficiency.

Figure 4A:
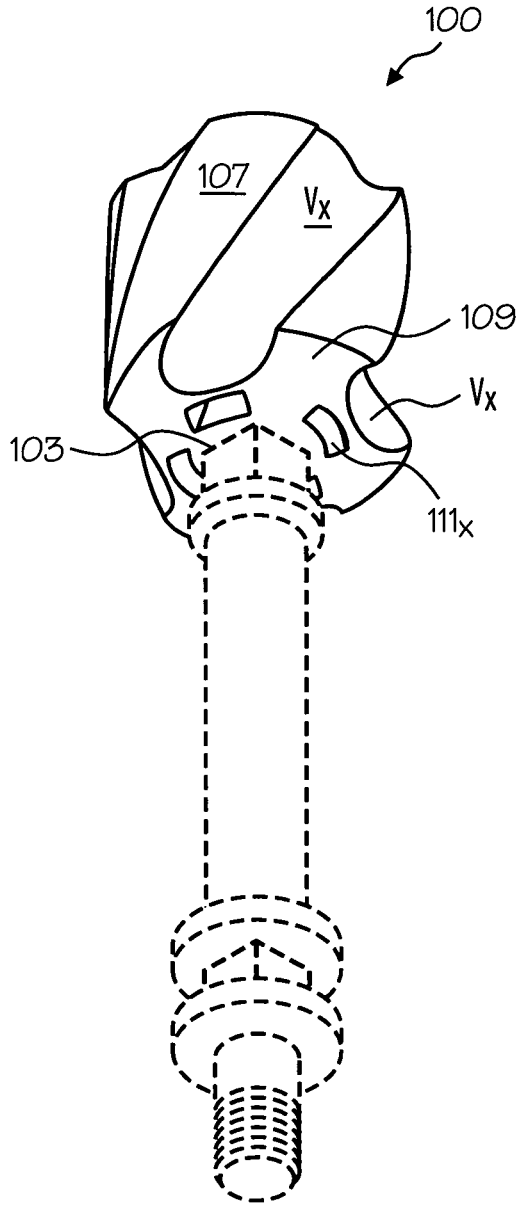
FIG. 4*a* illustrates an exemplary top side perspective of one embodiment of the present invention.
Figure 4B:
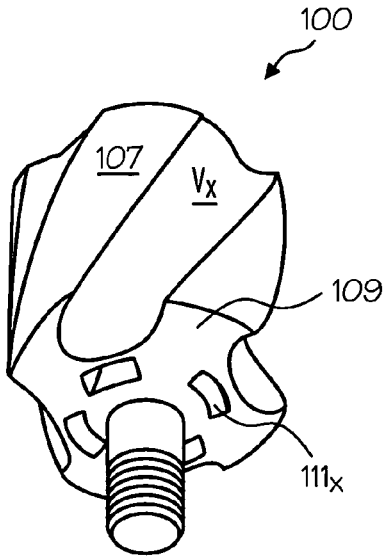
FIG. 4*b* illustrates another exemplary top side perspective of one embodiment of the present invention.
Figure 4C:
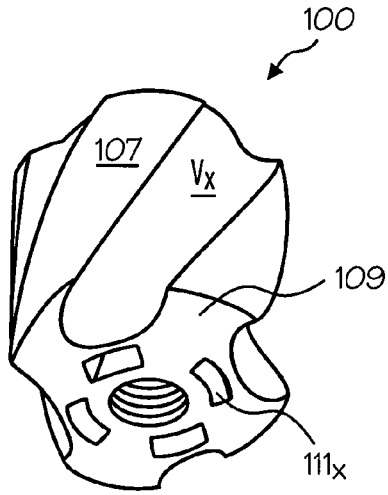
FIG. 4*c* illustrates a third exemplary top side perspective of one embodiment of the present invention.
Figure 5:
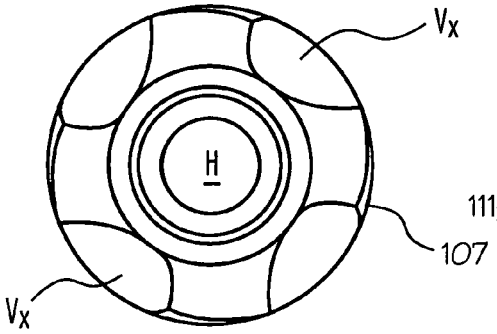
FIG. 5 illustrates an exemplary bottom plan view of the present invention featuring a hollow portion H.

Those of skill in the art will realize that several different configurations may be made to the present invention and still remain within the scope of this invention. Thus, for example, a handling portion 121 may not be necessary in some applications. As a consequence, as seen in FIG. 4*b*, the cone's top or pin end 103 may further include a male threaded portion, the male threaded portion preferably attachable to a rod string (not shown). Further, for example, as seen in FIG. 4*c*, the cone's top end 103 may further be defined as comprising an internally threaded female portion, the female portion preferably attachable to a rod string (not shown). Other means for coupling the cone 101 to a rod string R at the cone's top end 103 are also contemplated as being within the scope of the present invention.

Figure 8:
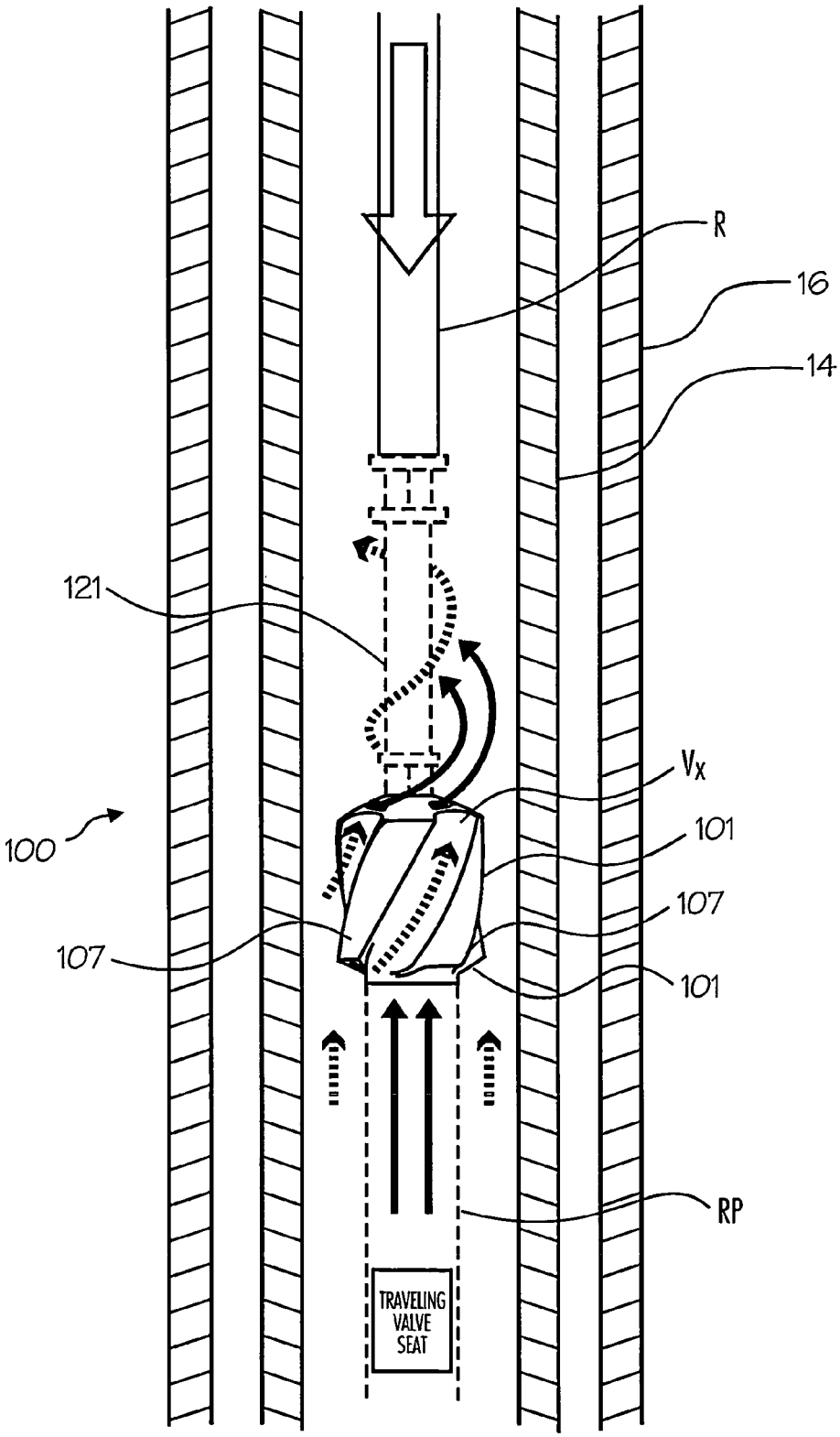
FIG. 8 is an operational illustration of the present invention during a down stroke cycle during a recovery operation.

In this regard as seen in FIG. 8, during operation, during the pumping process' upstroke, any fluid below and outside of the centralizing cone 101 will be forced vertically upwards through each vein $V_x$. This fluid flow will be complemented and assisted by the flow of fluid through each hole $\mathbf{111}_x$, as any fluid within the centralizing cone's hollow portion H will flow upward and through each hole $\mathbf{111}_x$ and be discharged into (or, otherwise, blend with) the circular jetting fluid flow from the veins $V_x$ which funnels and routes the fluid upwardly, thereby providing a synergistic vertical fluid flow effect in the tubing. With the centralizing cone being relatively close to the adjacent tubing surface, the veins $V_x$ are adapted to promote fluid flow in a circular or helical motion above the centralizing cone 101, substantially keeping any large amount of fluid from being forced onto the tubing surface. Further, the resulting fluid rotation distributes wear (if any) more evenly on the tubing surface. This synergistic vertical fluid flow effect thereby substantially reduces, if not eliminates, the horizontal or otherwise lateral fluid flow which erodes the adjacent tubing surfaces. By redirecting the fluid flow in this manner, less erosion occurs on the tubing, leading to a longer tubing life, and further promotes stabilization and centralizing of the rod sting as well.

The present invention, preferably, should be formed of a material or composite of materials which optimize its use for any particular downhole condition. Thus, for example, certain corrosive downhole environments would require a more non-corrosive material, whereas a non-corrosive downhole environment may require a different material composition.

Those of skill in the art will soon realize the numerous advantages found when utilizing the present invention. For example, the present invention results in a significant cost savings for pumping procedures. The present invention further results in improved environmental impact, and further, results in using a significantly reduced amount of parts for pumping procedures. The present invention also has the advantage of a disclosing a vertical flow cage which is adapted to substantially prevent the erosion or abrasion of a tubing's interior surfaces, thereby resulting in a lower cost recovery operation.

As seen in FIG. 8 for example, the present invention further accomplishes its desired objectives by providing a method for pumping well fluids from a well hole having the steps of coupling a generally hollow vertical flow cage 100 between a downhole pump RP and a sucker rod R in a tubing chamber, the vertical flow cage 100 comprising a centralizing cone 101 having a top or pin end 103 and a internally threaded bottom end (not shown) attached to a subsurface pump RP, wherein the bottom end is in fluid flow communication with the subsurface pump RP, the centralizing cone further comprising at least one spiral turbulating channel or vein $V_x$, the centralizing cone further comprising a ledge 109 having at least one discharge port or hole $\mathbf{111}_x$ disposed thereon, with each discharge hole $\mathbf{111}_x$ being located above each vein $V_x$; reciprocating the cage 100 in the tubing; and during the pumping process' down stroke cycle, causing any fluid below and outside of the centralizing cone 101 (e.g., a first fluid) to be forced vertically upwards through each vein $V_x$ so that fluid flow will be complemented and assisted by the flow of fluid through each hole $\mathbf{111}_x$ (e.g., a second fluid) as any fluid within the hollow portion H will flow upward and through each hole $\mathbf{111}_x$ and be discharged into and blended with the circular jetting fluid flow from the veins Benefits, other advantages, and solutions to problems have been described above with regard to specific embodiments. However, the benefits, advantages, solutions to problems, and any element(s) that may cause any benefit, advantage, or solution to occur or become more pronounced are not to be construed as critical, required, or essential features or elements of any or all the claims. As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus. Further, no element described herein is required for the practice of the invention unless expressly described as "essential" or "critical".

Other variations and modifications of the present invention will be apparent to those of ordinary skill in the art, and it is the intent of the appended claims that such variations and modifications be covered. The particular values and configurations discussed above can be varied, are cited to illustrate representative embodiments of the present invention and are not intended to limit the scope of the invention. It is contemplated that the use of the present invention can involve components having different characteristics as long as the principle is followed.

I claim:

1. A flow cage attachable to a subsurface pump in a down hole pumping process having tubing, the flow cage comprising a single centralizing cone portion with a hollow interior portion within the tubing and attachable to a pump barrel of the subsurface pump, the cone portion having at least one spiral vein formed in the cone's surface, the cone portion having a circumferential diameter greater than a circumferential diameter of the pump barrel, the cone portion further having a top ledge portion with at least one discharge hole disposed thereon, each discharge hole formed through the centralizing cone and being in fluid communication with the hollow interior.

2. The cage of claim 1, wherein each discharge hole is selectively formed on the top ledge portion above each vein.

3. The cage of claim 1, wherein each discharge hole is formed on the top ledge portion in substantial registration with each vein.

4. The cage of claim 1 wherein the cone further comprises an internally threaded bottom end.

5. The cage of claim 4 wherein the bottom end is in fluid flow communication with the hollow interior portion.

6. The cage of claim 5 wherein each vein is formed on the cone's surface equidistantly around the circumference of the cone's surface.

7. The cage of claim 1 further including a handling means, the handling means having a first handling end and a second handling end, the handling means adapted to couple the centralizing cone on the first handling end to a rod string on the second handling end.

8. The cage of claim 1 wherein each hole has a hole surface area diameter on the on the top ledge portion, and wherein the combination of the hole surface area diameters are at least one and a half times greater than a diameter of a hole within a traveling valve seat in the subsurface pump.

9. The cage of claim 1 wherein the cone's top end further comprises a male threaded portion, the male threaded portion being attachable to a rod string.

10. The cage of claim 1 wherein, the cone's top end further comprises an internally threaded female portion, the female portion being attachable to a rod string.

11. A vertical flow cage attachable to a subsurface pump in a down hole pumping process having tubing, the flow cage comprising a centralizing cone portion with a hollow interior portion within the tubing and attachable to a pump barrel of the subsurface pump, the cone portion having a circumferential diameter greater than a circumferential diameter of the pump barrel, the cone portion having at least one spiral vein formed in the cone's surface, the cone portion further having a top ledge portion with at least one discharge hole disposed thereon, each discharge hole formed through the centralizing cone and being in fluid communication with the hollow interior, and each discharge hole is formed on the top ledge portion approximately above each vein, the cone further comprising an internally threaded bottom end, the bottom end being in fluid flow communication with the hollow interior portion.

12. The cage of claim 11 further including a male threaded portion at the cone's top end, the male threaded portion being attachable to a rod string.

13. The cage of claim 11 further including an internally threaded female threaded portion at the cone's top end, the threaded female portion being attachable to a rod string.

14. The cage of claim 11 wherein each hole has a hole surface area diameter on the on the top ledge portion, and wherein the combination of the hole surface area diameters are at least one and a half times greater than a diameter of a hole within a traveling valve seat in the subsurface pump.

15. A method of redirecting fluid flow to substantially reduce erosion in a downhole tubing system which uses a subsurface pump in a pumping process having an upstroke, the steps comprising:

attaching a centralizing vertical flow cage between a subsurface pump and a rod string, the flow cage comprising a centralizing cone portion with a hollow interior portion, the cone portion having at least one spiral vein formed in the cone's surface, the cone portion having a circumferential diameter greater than a circumferential diameter of a barrel of the subsurface pump, the cone portion further having a top ledge portion with at least one discharge hole disposed thereon, each discharge hole formed through the centralizing cone and being in fluid communication with the hollow interior, the cone further comprising an internally threaded bottom end, the bottom end being in fluid flow communication with the hollow interior portion and the subsurface pump;

during the pumping process' upstroke, forcing a first fluid arising from the subsurface pump below and outside of the centralizing cone vertically upwards through each vein, forcing a second fluid arising from the subsurface pump through each hole vertically upwards, and blending the first fluid and the second fluid in a helical pattern above the centralizing cone to create a synergistic vertical fluid flow effect in the tubing system.

16. The method of claim 15, wherein each hole has a surface area on the on the top ledge portion, and wherein the combination of the hole surface area diameters are at least one and a half times greater than a diameter of a hole within a traveling valve seat found in the subsurface pump.

17. The method of claim 16 wherein the cone further comprises an internally threaded bottom end, the bottom end being in fluid flow communication with the hollow interior portion.

18. The method of claim 15 wherein each discharge hole is formed on the top ledge portion approximately above each vein.

19. The method of claim 18, the cone further having a top end, the top end further comprising a male threaded portion which is attachable to a rod string.

20. The method of claim 18, the cone further having a top end, the top end further comprising an internally threaded female portion which is attachable to a rod string.

* * * * *